US007543351B1

(12) United States Patent
Nobile et al.

(10) Patent No.: US 7,543,351 B1
(45) Date of Patent: Jun. 9, 2009

(54) CLEANROOM MOPPING SYSTEM

(75) Inventors: David P. Nobile, Alta Loma, CA (US); Jackson S. Burnett, III, Spartanburg, SC (US)

(73) Assignee: Contec, Inc., Spartanburg, SC (US)

( * ) Notice: Subject to any disclaimer, the term of this patent is extended or adjusted under 35 U.S.C. 154(b) by 161 days.

(21) Appl. No.: 11/788,700

(22) Filed: Apr. 20, 2007

(51) Int. Cl.
*A47L 13/24* (2006.01)
*A47L 13/46* (2006.01)

(52) U.S. Cl. ..... 15/244.1; 15/147.1; 15/228; 15/244.2

(58) Field of Classification Search ..... 15/228, 15/244.1, 147.1, 147.2, 244.2
See application file for complete search history.

(56) References Cited

U.S. PATENT DOCUMENTS 3,050,761 A * 8/1962 Morgan ..... 15/119.2
3,795,933 A 3/1974 Seufert
3,945,736 A 3/1976 Rittenbaum et al.
3,991,431 A * 11/1976 Thielen ..... 15/147.2
4,216,562 A 8/1980 Strahs
4,509,224 A * 4/1985 Batchelor ..... 15/244.1
4,852,210 A 8/1989 Krajicek
4,903,366 A 2/1990 Traglia
4,991,250 A * 2/1991 Young ..... 15/228
5,331,711 A * 7/1994 Kelly ..... 15/210.1
5,507,065 A 4/1996 McBride et al.
5,678,278 A 10/1997 McBride et al.
D403,820 S 1/1999 Chang
6,058,552 A 5/2000 Hanan
6,148,465 A 11/2000 Hsieh et al.
6,591,442 B2 * 7/2003 Kaminstein ..... 15/228
2006/0248673 A1 11/2006 Piscane
2006/0248674 A1 11/2006 Piscane

FOREIGN PATENT DOCUMENTS

WO WO 00/19882 4/2000
WO WO 2006/098898 9/2006

* cited by examiner

*Primary Examiner*—Randall Chin
(74) *Attorney, Agent, or Firm*—Leydig, Voit & Mayer, Ltd.

(57) ABSTRACT

A mop system for cleanroom use incorporating an autoclavable mop head adapted for snap-on, pressure fit attachment to a frame member having a pair of substantially planar free end portions. The mop head incorporates raised profile insert elements engaging free end portions of the frame member. The mop head is also optionally adapted to retain a dusting cloth or other web structure in removable relation across its surface.

15 Claims, 4 Drawing Sheets

CLEANROOM MOPPING SYSTEM

TECHNICAL FIELD

This invention relates generally to mopping systems and more particularly to a mop system incorporating an autoclavable replaceable mop head adapted for pressure fit attachment to a substantially planar mop frame. The mop head is adapted to provide low levels of particle contamination and may be particularly suitable for use in cleanroom environments.

BACKGROUND OF THE INVENTION

Mopping systems incorporating replaceable sponge-based refills are generally known. By way of example, replaceable sponge-based mop heads are described in U.S. Pat. Nos. 4,216,562 to Strahs, 6,058,552 to Hanan and 6,148,465 to Hsieh et al., the teaching of all of which are incorporated herein by reference. As will be appreciated, prior mop constructions have typically relied on relatively complex clamping systems, solid surface attachment plates, and/or threaded attachment elements such as screws and the like in order to provide a desired operative connection between a replaceable refill and the handle structure. Each of these attachment systems has certain inherent limitations. By way of example, systems which utilize clamping engagement between a mop head and handle structure may require a relatively complex clamp structure which may tend to corrode or otherwise degrade over time in the presence of cleaning solutions. Likewise, mop systems which utilize screws and/or other threaded fasteners may be prone to premature failure at the point of mechanical connection. Systems which utilize foam refills backed by solid surface connection plates may rely on relatively complex attachment mechanisms for connection to mop frames.

SUMMARY OF THE INVENTION

The present invention provides advantages and/or alternatives over the prior art by providing a mop system incorporating an autoclavable mop head adapted for snap-on, pressure fit attachment to a frame member having a pair of substantially planar free end portions.

According to a potentially preferred feature, the mop head is also optionally adapted to retain a dusting cloth or other web structure in removable relation across its surface.

Other aspects and features of the invention will become apparent to those of skill in the art through reference to the following detailed description of exemplary embodiments and accompanying figures and/or through practice of the invention.

While the invention has been illustrated and will hereinafter be described in connection with certain exemplary and potentially preferred embodiments, practices and procedures, it is to be understood that the invention is in no way limited to any such illustrated and described embodiments, practices or procedures. Rather, it is to be understood that it is the intention of the applicants to cover all alternatives and modifications and all equivalents thereto as may fall broadly within the trust spirit and scope of the inventive concepts herein.

DESCRIPTION OF PREFERRED EMBODIMENTS

Figure 1:
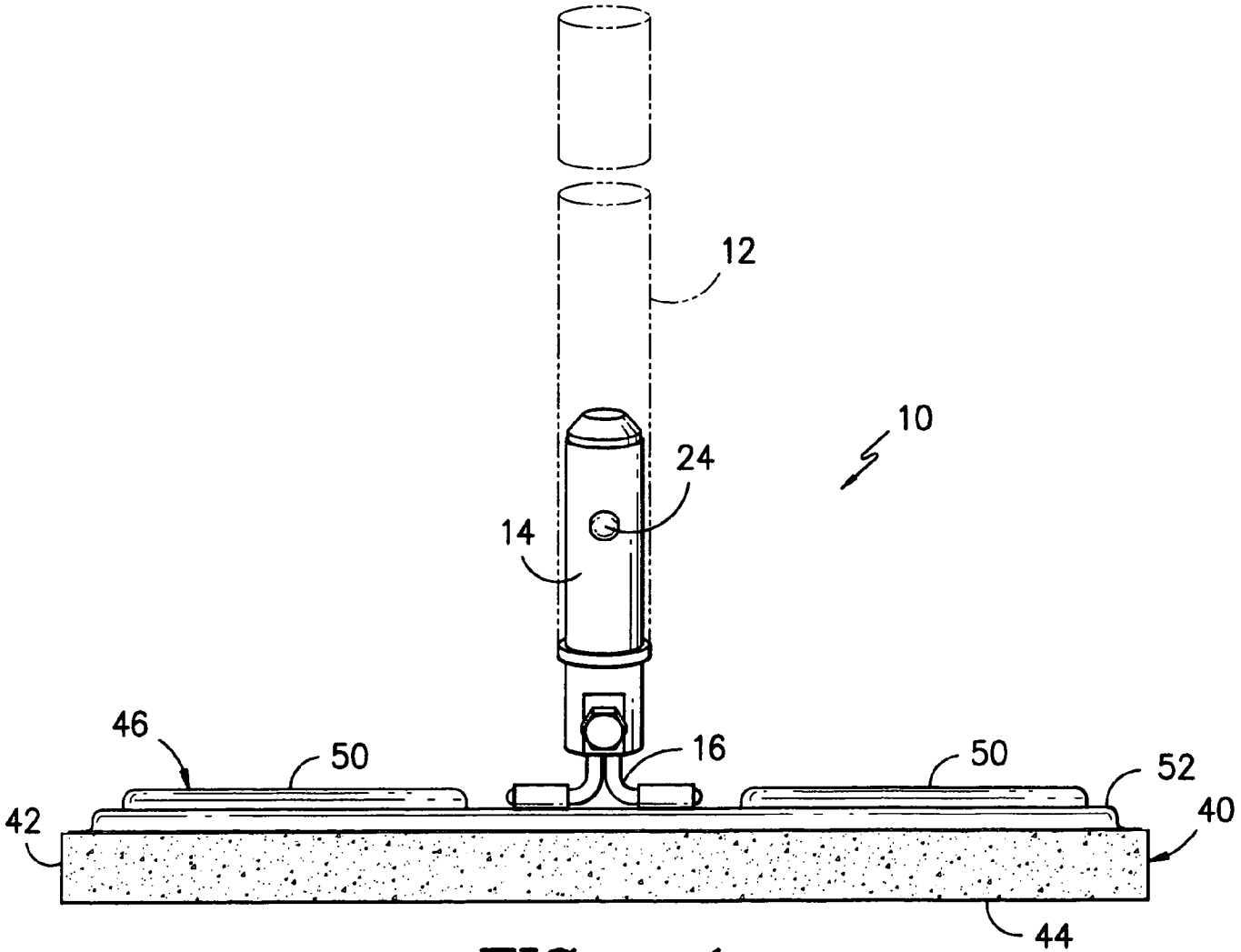
FIG. 1 is a side view of a mop system incorporating a replaceable foam body head in attached pressure fit relation to a frame supporting a handle connection.

Reference will now be made to the drawings wherein to the extent possible like reference numerals are utilized to designate like elements throughout the various views. Referring to FIG. 1, an exemplary mop 10 is illustrated. As shown, the mop 10 includes a removable elongate handle 12 attached to a pivoting handle connection 14. In the illustrated and potentially preferred configuration, the handle connection 14 is held in pivoting relation to a frame 15 (FIG. 2) by a hairpin bracket structure 16. According to the illustrated and potentially preferred configuration, the pivot connection and frame are preferably substantially as disclosed in U.S. Pat. No. 5,507,065 to McBride et al. the contents of which are incorporated herein by reference in their entirety.

Figure 2:
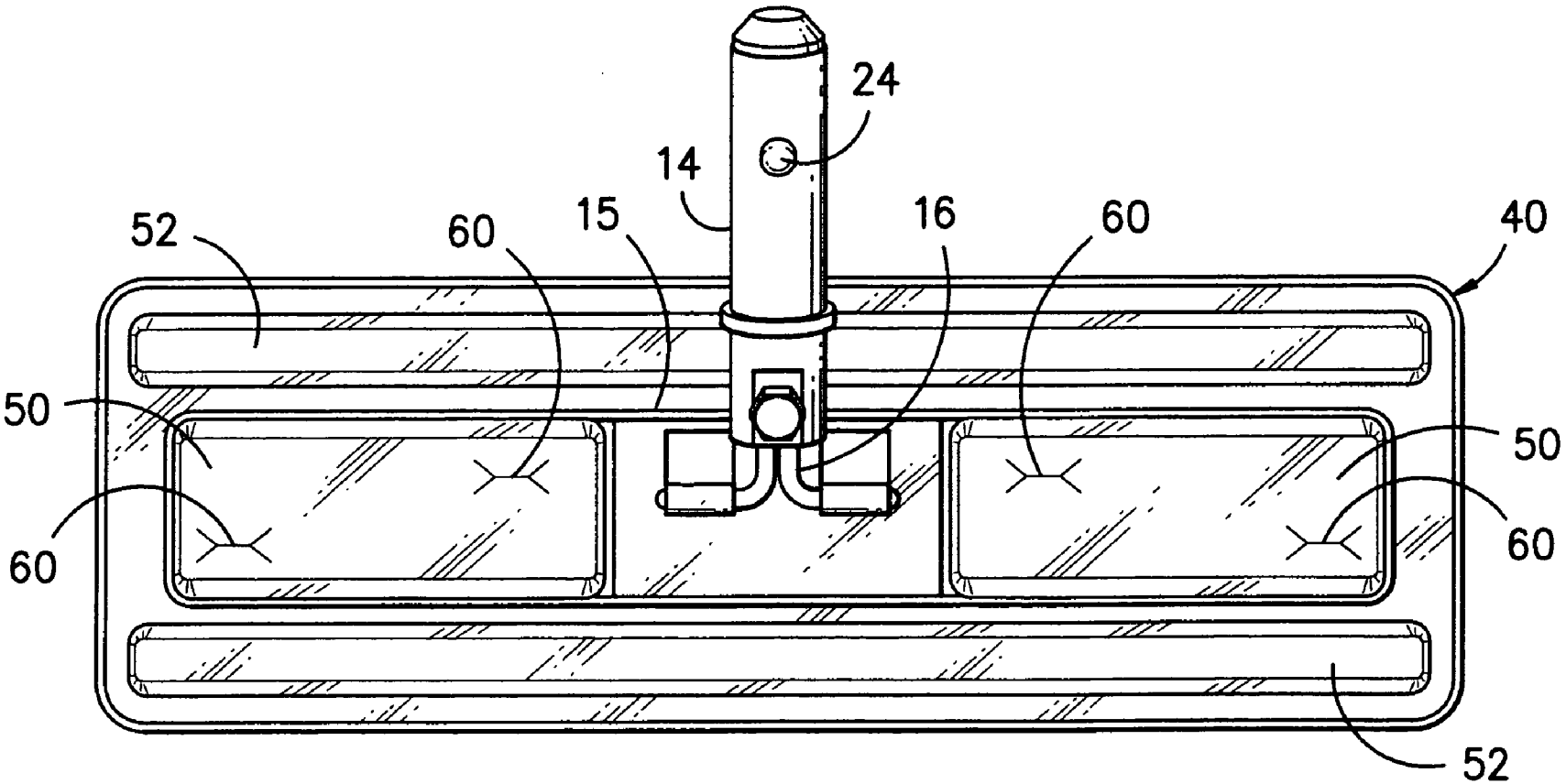
FIG. 2 is an elevation view illustrating the top of the replaceable foam body head in attached pressure fit relation to a frame supporting a handle connection.
Figure 3:
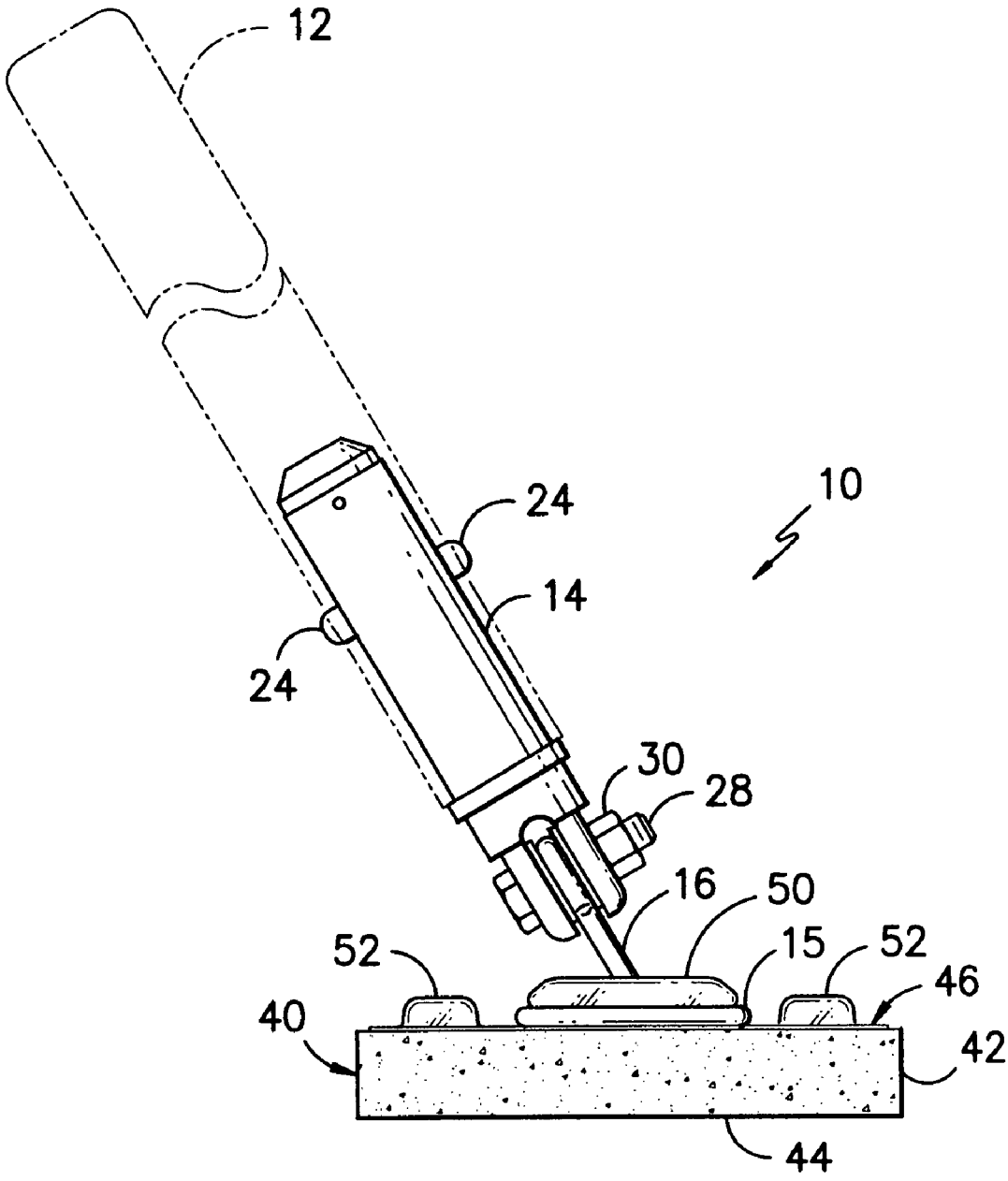
FIG. 3 is an end view of the replaceable foam body head in attached pressure fit relation to a frame supporting a handle connection.

Referring simultaneously to FIGS. 1-3, various features of the pivoting handle connection 14 will now be described. As shown, the handle connection 14 is preferably substantially tubular in construction incorporating a pair of outwardly projecting spring bias pin elements 24 adapted to engage aligned openings in the handle 12 when the handle is placed over the handle connection 14. In the potentially preferred construction, the spring biased pin elements 24 are operatively connected to a biasing element in the form of a compressible U-shaped leaf spring disposed at the interior of the connection 14. However, virtually any other suitable biasing structure may likewise be used if desired.

As noted previously, the handle connection 14 is preferably held in pivoting relation relative to the frame 15 by a hairpin bracket structure 16. As best illustrated in FIG. 3, in the potentially preferred construction a bolt 28 extends through the "keyhole" at the base of the hairpin bracket structure 16. A tensioning nut 30 secures the bolt 28 in place and may be tightened or loosened so as to adjust the force required to pivot the handle connection 14 in the manner as may be desired. As will be appreciated, the mounting arrangement between the handle connection 14 and the frame 15 permits the handle 12 to be pivoted to substantially any desired angle relative to the frame 15.

As illustrated, the mop 10 includes a replaceable mop head 40 adapted for disposition in pressure fit attached relation to frame 15. In this illustrated construction, the mop head 40 preferably includes a block of absorbent cellular foam 42 as will be well known to those of skill in the art with a layer of fabric 44 disposed in laminated relation across one side of the foam 42. The block of absorbent cellular foam 42 is normally substantially planar. By "normally substantially planar" it is meant that the block does not have substantial inherent edge to edge curvature.

The fabric 44 is preferably a non-snagging knit polyester fabric although other fabrics may likewise be utilized if desired. The fabric 44 is preferably secured to the foam 42 by flame lamination although adhesives or other attachment techniques may likewise be utilized if desired. While it is contemplated that the fabric 44 may cover only the lower face of the foam, it is likewise contemplated that the fabric 44 may also cover the upper face of the foam and/or any or all of the vertical surfaces of the mop head 40 if desired.

As shown, the mop head 40 preferably incorporates a raised profile contoured attachment plate 46 across the upper face of the foam 42. The attachment plate 46 may be fixed across the upper face of the foam by an adhesive disposed in a selective pattern between the attachment plate 46 and the upper face of the foam 42. The attachment plate 46 is preferably constructed from a relatively light gauge moldable plastic formed to a desired shape by techniques such as thermoforming, injection molding, blow molding or the like.

Figure 4:
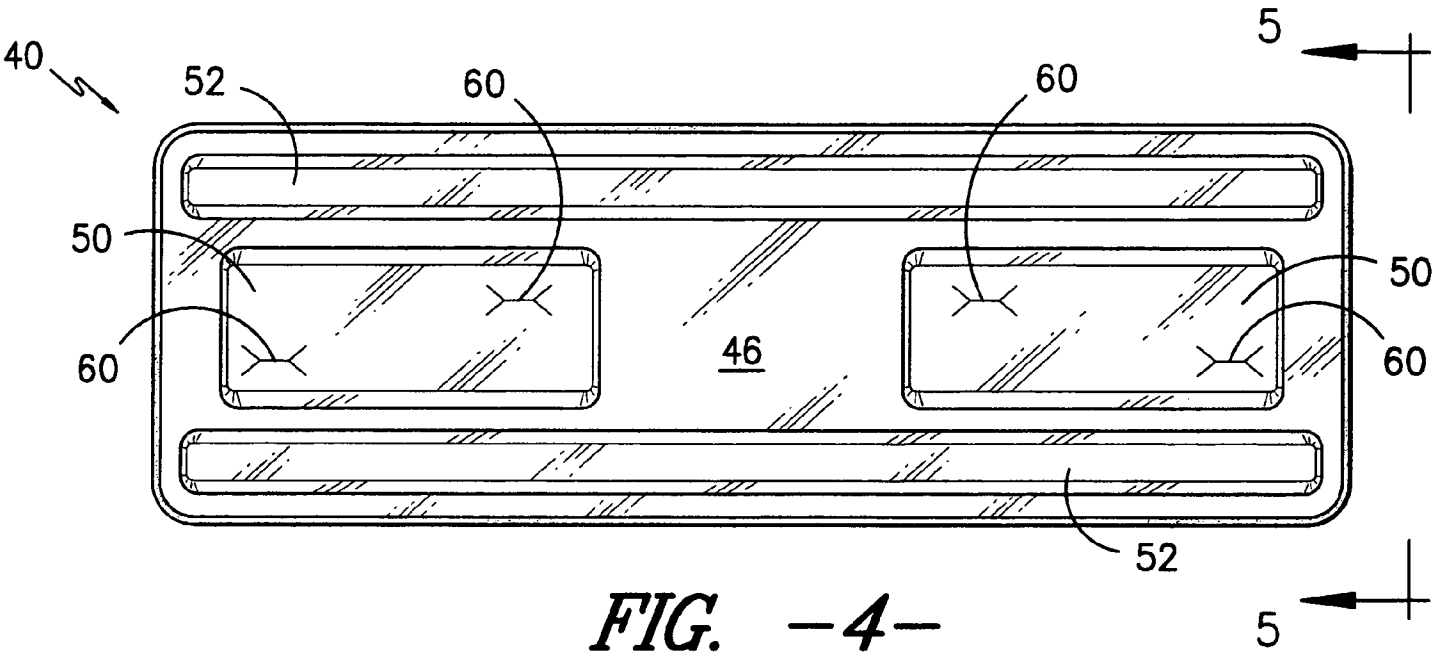
FIG. 4 is an elevation view illustrating the top of the replaceable foam body head free of engagement with the frame.
Figure 5:
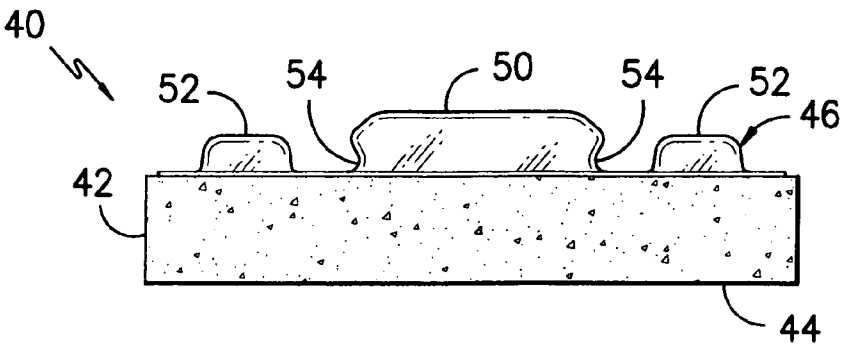
FIG. 5 is an end view of the replaceable foam body head taken generally along line 5-5 in FIG. 4.

It is contemplated that the attachment plate 46 will incorporate a pattern of raised profile regions with underlying voids adapted to engage and retain frame 15 in pressure fit relation. The attachment plate 46 also incorporates depressed profile zones defining a base providing surfaces for attachment to the foam 42. By way of example only, and not limitation, FIGS. 2, 4 and 5 illustrate one contemplated configuration for the attachment plate 46 which is adapted to retain a frame 15 such as a wire frame having a central plate for connection to hairpin bracket structure 16 with a pair of substantially planar free end portions as illustrated and described in U.S. Pat. No. 5,507,065. In this configuration the attachment plate 46 includes raised profile insert structures 50 configured for pressure fit insertion through openings in the free end portions of frame 15.

In the illustrated and potentially preferred configuration a substantially matched pair of raised profile insert structures 50 are utilized which substantially correspond in size and shape to the openings in the free end portions of frame 15. However, it is likewise contemplated that other arrangements of raised profile insert structures may be used if desired. By way of example only, it is contemplated that an alternative arrangement may utilize multiple raised profile insert structures of smaller dimensions such as a row of squares or other shapes for insertion through free end portions of frame 15 in place of the illustrated single insert structures.

Regardless of the shape of the raised profile insert structures, it is contemplated that the raised profile insert structures are preferably substantially hollow so as to define voids between the upper surface of the foam 42 and the interior of the attachment plate 46. Accordingly, the raised profile insert structures are slightly compressible when subjected to pressure. According to a potentially preferred practice, the raised profile insert structures incorporate a flared distal surface overlying a reduced diameter body portion 54 such that edges of the flared distal surface slightly overhang the reduced diameter body portion 54. As shown, the edges of the flared distal surface are preferably slightly chamfered so as to facilitate sliding insertion through the frame 15. As best illustrated in FIGS. 3 and 5, this arrangement permits perimeter wire elements of the frame member 15 to be pressed over the flared distal surface and to then nest with the reduced diameter body portion 54 with perimeter elements of frame 15 pressing into the sides of the insert structure. The compression force of frame 15 against the reduced diameter body portion 54 in combination with the overhanging edge of the flared distal surface thereby holds frame 15 in place until an adequate disengaging pulling force is applied by an operator.

As illustrated, the attachment plate 46 may also include an arrangement of raised profile reinforcement elements 52. In the illustrated and potentially preferred configuration, substantially matched raised profile reinforcement elements 52 are disposed substantially along the length of the attachment plate 46 between the raised profile insert structures 50 and the outboard edges of the attachment plate 46. Such reinforcement elements may aid in providing flexural rigidity to the mop head 40. Of course, it is likewise contemplated that other arrangements of raised profile reinforcement elements may be used if desired.

While the mop 10 is fully functional in the condition as illustrated and described, it is contemplated that the mop head 40 may be adapted to facilitate the use of use of a removable dust cloth (not shown) such as a low weight woven or non-woven sheet or the like as will be well known to those of skill in the art. As illustrated, in order to facilitate use of such a removable dust cloth, slits 60 may be applied in a predefined arrangement across raised profile surfaces of the attachment plate 46. As will be appreciated, since such raised profile surfaces stand away from the upper surface of the foam 42, cavities are present between the foam 42 and the slits 60. Thus, the dust cloth may be wrapped around the mop head 40 and portions of the dust cloth may be pressed through the slits 60 and into the underlying cavities thereby holding the dust cloth in place around mop head 40 if desired. Of course, the slits 60 may be of virtually any shape as may be desired including the illustrated elongate configuration with angled legs, a straight slot configuration, a star shaped configuration with radially extending legs or the like.

It is to be understood that while the present invention has been illustrated and described in relation to potentially preferred embodiments, constructions and procedures, that such embodiments, constructions and procedures are illustrative only and that the invention is in no event to be limited thereto. Rather, it is contemplated that modifications and variations embodying the principles of the invention will no doubt occur to those with ordinary skill in the art. It is therefore contemplated and intended that the present invention shall extend to all such modifications and variations as may incorporate the broad principle of the invention within the true spirit and scope thereof.

The invention claimed is:

1. A replaceable, autoclavable mop head adapted to engage a handle-manipulated frame having a pair of substantially planar free ends, the free ends having open zones at least partially surrounded by wire perimeter elements, the mop head comprising:

a cellular foam body of predefined thickness;

a fabric layer adhered in fixed relation at least partially across a lower face of the foam body; and an attachment plate disposed in fixed relation across an upper face of the foam body, the attachment plate comprising a base and a plurality of enclosed raised profile insert structures adapted for press fit insertion at least partially through the open zones in the free ends, wherein at least a portion of the raised profile insert structures comprise a flared distal surface and a reduced diameter body disposed between the base and the flared distal surface, wherein the flared distal surface is adapted to pass in compressed relation through open zones in the free ends such that at least a portion of the wire perimeter elements are held against the reduced diameter body in underlying relation to edge portions of the flared distal surface.

2. The replaceable, autoclavable mop head as recited in claim 1, wherein the flared distal surface includes a chamfered edge.

3. The replaceable, autoclavable mop head as recited in claim 1, wherein the mop head is substantially rectangular and further comprising a pair of raised profile reinforcement elements disposed outboard of the raised profile insert structures in substantially parallel relation to opposing edges of the mop head.

4. The replaceable, autoclavable mop head as recited in claim 1, further comprising a plurality of slit openings disposed across at least a portion of the raised profile insert structures.

5. The replaceable, autoclavable mop head as recited in claim 1, wherein the base of the attachment plate is adhesively bonded to the upper face of the foam body.

6. The replaceable, autoclavable mop head as recited in claim 1, wherein the fabric layer is flame laminated across the lower face of the foam body.

7. A replaceable, autoclavable mop head adapted to engage a handle-manipulated frame having a pair of substantially planar free ends, the free ends having open zones at least partially surrounded by wire perimeter elements, the mop head comprising:

a cellular foam body of predefined thickness;

a fabric layer adhered in fixed relation at least partially across a lower face of the foam body; and an attachment plate disposed in fixed relation across an upper face of the foam body, the attachment plate comprising a base and a pair of enclosed raised profile insert structures, wherein the raised profile insert structures each comprise a flared distal surface and a reduced diameter body disposed between the base and the flared distal surface, wherein the flared distal surface is adapted to pass in compressed aligned relation through an open zone in a free end such that at least a portion of the wire perimeter elements are held against the reduced diameter body in underlying relation to edge portions of the flared distal surface.

8. The replaceable, autoclavable mop head as recited in claim 7, wherein the flared distal surface includes a chamfered edge.

9. The replaceable, autoclavable mop head as recited in claim 7, wherein the mop head is substantially rectangular and further comprising a pair of raised profile reinforcement elements disposed outboard of the raised profile insert structures in substantially parallel relation to opposing edges of the mop head.

10. The replaceable, autoclavable mop head as recited in claim 7, further comprising a plurality of slit openings disposed across at least a portion of the raised profile insert structures.

11. The replaceable, autoclavable mop head as recited in claim 7, wherein the base of the attachment plate is adhesively bonded to the upper face of the foam body.

12. A replaceable, autoclavable mop head adapted to engage a handle-manipulated frame having a pair of substantially planar free ends, the free ends having open zones at least partially surrounded by wire perimeter elements, the mop head comprising:

a cellular foam body of predefined thickness;

a fabric layer flame laminated in fixed relation at least partially across a lower face of the foam body; and an attachment plate disposed in fixed relation across an upper face of the foam body, the attachment plate comprising a base and a pair of raised profile insert structures, wherein the raised profile insert structures each comprise a flared distal surface having a chamfered edge and a reduced diameter body disposed between the base and the flared distal surface, wherein the flared distal surface is adapted to pass in compressed aligned relation through an open zone in a free end such that at least a portion of the wire perimeter elements are held against the reduced diameter body in underlying relation to edge portions of the flared distal surface, wherein the mop head is substantially rectangular and wherein a pair of raised profile reinforcement elements is disposed outboard of the raised profile insert structures in substantially parallel relation to opposing edges of the mop head.

13. The replaceable, autoclavable mop head as recited in claim 12, further comprising a plurality of slit openings disposed across at least a portion of the raised profile insert structures.

14. The replaceable, autoclavable mop head as recited in claim 12, further comprising a plurality of slit openings disposed across at least a portion of the raised profile reinforcement elements.

15. The replaceable, autoclavable mop head as recited in claim 12, wherein the base of the attachment plate is adhesively bonded to the upper face of the foam body.

* * * * *